US006044731A

United States Patent [19]

Hsieh

[11] Patent Number: 6,044,731

[45] Date of Patent: Apr. 4, 2000

[54] DOUBLE-REVERSIBLE RATCHET WRENCH

[76] Inventor: Chih-Ching Hsieh, No. 64, Lane 107, Liang Tsun Rd., Fong Yuan City, Taichung Hsien, Taiwan

[21] Appl. No.: 09/276,136

[22] Filed: Mar. 25, 1999

[51] Int. Cl.[7] ..... B25B 13/46

[52] U.S. Cl. ..... 81/63.2; 81/63; 81/60; 81/63.1

[58] Field of Search ..... 81/63.2, 58.4, 81/60, 63

[56] References Cited

U.S. PATENT DOCUMENTS 4,257,507 3/1981 Solomon ..... 192/43.1
5,960,680 10/1999 Chen et al. ..... 81/63.2

*Primary Examiner*—James G. Smith
*Assistant Examiner*—Hadi Shakeri
*Attorney, Agent, or Firm*—Varndell & Varndell, PLLC

[57] ABSTRACT

A double-reversible ratchet wrench, which includes a body having a receiving chamber at one end, a ratchet wheel mounted within the receiving chamber, a stop block with two toothed portions mounted within the receiving chamber and meshed with the ratchet wheel to limit the direction of rotation of the ratchet wheel, a retainer ring mounted around the ratchet wheel inside the receiving chamber to hold the stop block in place, and an adjustment member mounted in the receiving chamber and turned to shift the stop block between two positions to control the reversing direction of the ratchet wheel.

2 Claims, 5 Drawing Sheets

DOUBLE-REVERSIBLE RATCHET WRENCH

BACKGROUND AND SUMMARY OF THE INVENTION

The present invention relates to reversible ratchet wrenches, and more particularly to a double-reversible ratchet wrench which uses an adjustment member to control the position of a stop block in controlling the reversing direction of a ratchet wheel.

Various wrenches are well known for turning bolts, nuts, etc. Conventional wrenches such as combination wrenches, Allen (hes) wrench, monkey wrench, are not reversible. They must be disconnected from the work piece after each turning stroke, and then attached to the work piece before a second turning stroke. In order to eliminate this drawback, several reversible wrenches have been disclosed. These reversible wrenches work when turn in one direction, or run idle when turn in the reversed direction. However, these reversible wrenches can only be used to turn bolts, nuts, etc., in one direction only. For turning bolts, nuts, etc., in the reversed direction, a different reversible wrench shall be used.

The present invention has been accomplished under the circumstances in view. According to one aspect of the present invention, the double-reversible ratchet wrench comprises a body, which has a head at one end of an elongated handle thereof and a receiving chamber at the head, a ratchet wheel mounted within the receiving chamber, a stop block wilt two toothed portions mounted within the receiving chamber and meshed with the ratchet wheel to limit the direction of rotation of the ratchet wheel, a retainer ring mounted around the ratchet wheel inside the receiving chamber to hold the stop block in place, and an adjustment member mounted in the receiving chamber and turned to shift the stop block between two positions to control the reversing direction of the ratchet wheel. According to another aspect of the present invention, the head of the body is axially upwardly extended from one end of the handle at an angle, for example, 15° angle, therefore the handle can be efficiently operated with the hand to turn the ratchet wheel with less effort.

DETAILED DESCRIPTION OF THE PREFERRED EMBODIMENT

Figure 1:
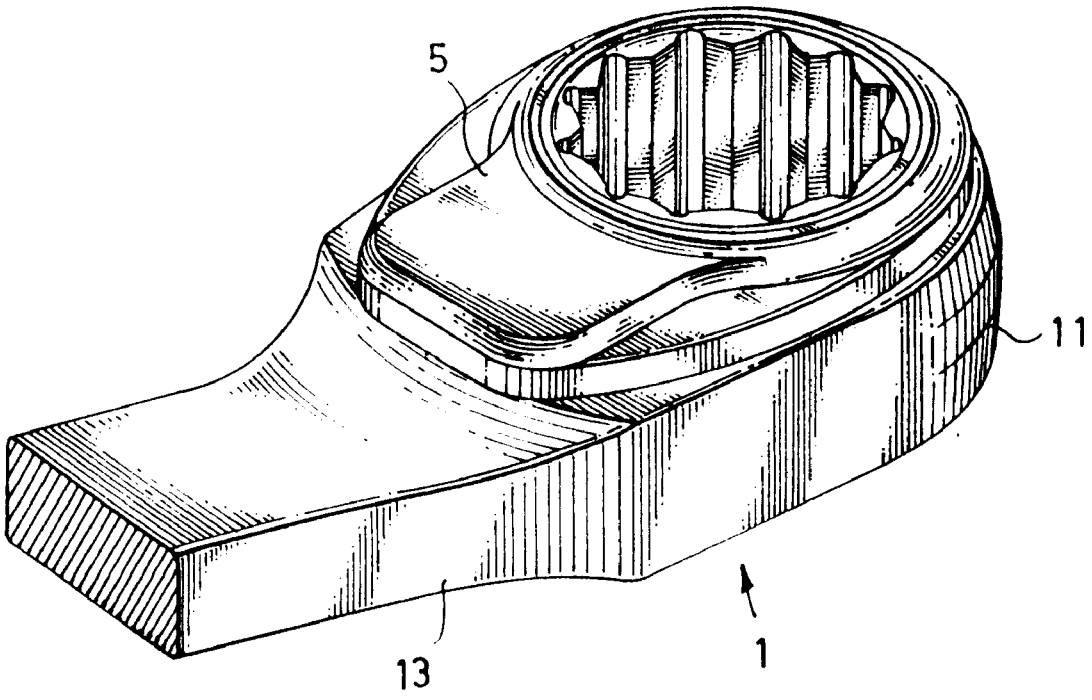
FIG. 1 is a perspective view of a double-reversible ratchet wrench according to the present invention.
Figure 2:
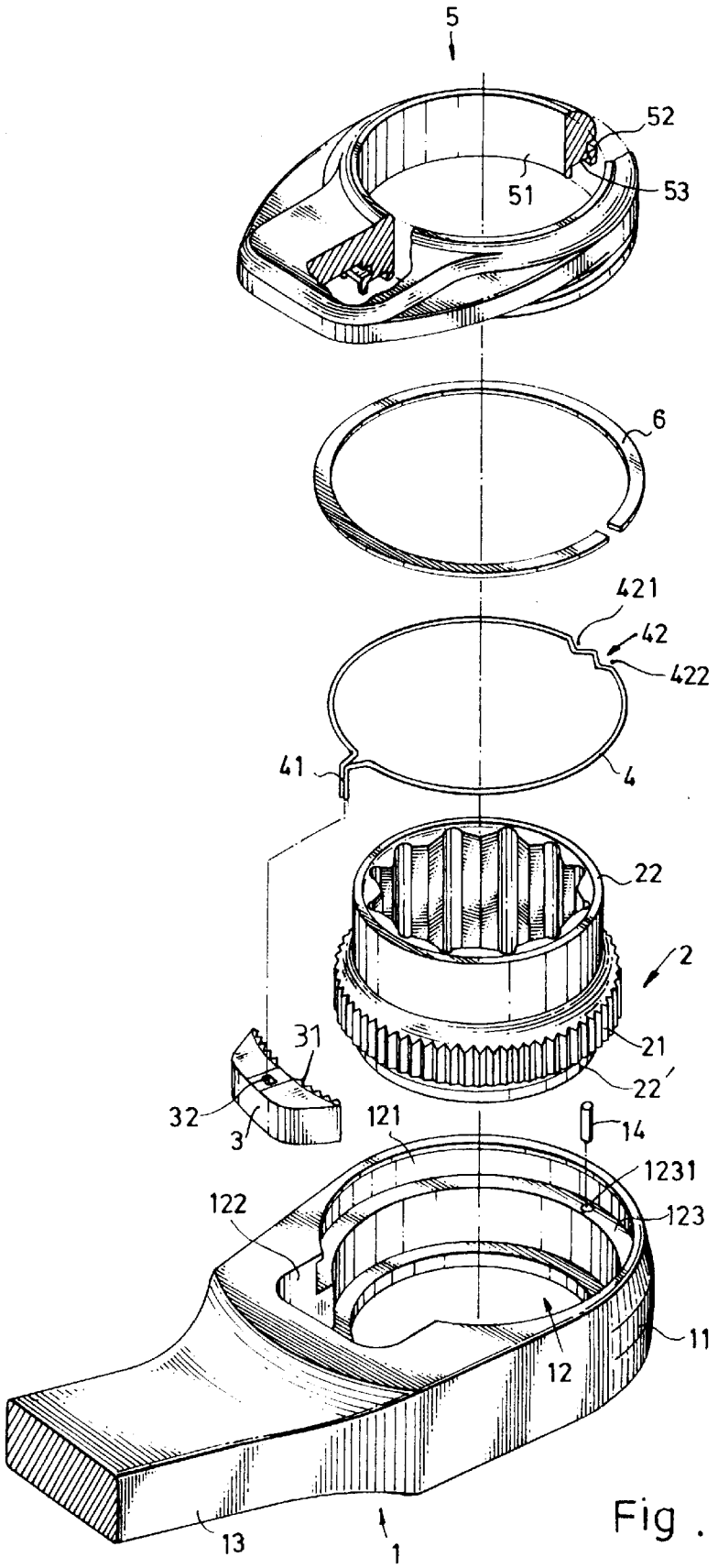
FIG. 2 is an exploded view of the double-reversible ratchet wrench shown in FIG. 1.
Figure 3:
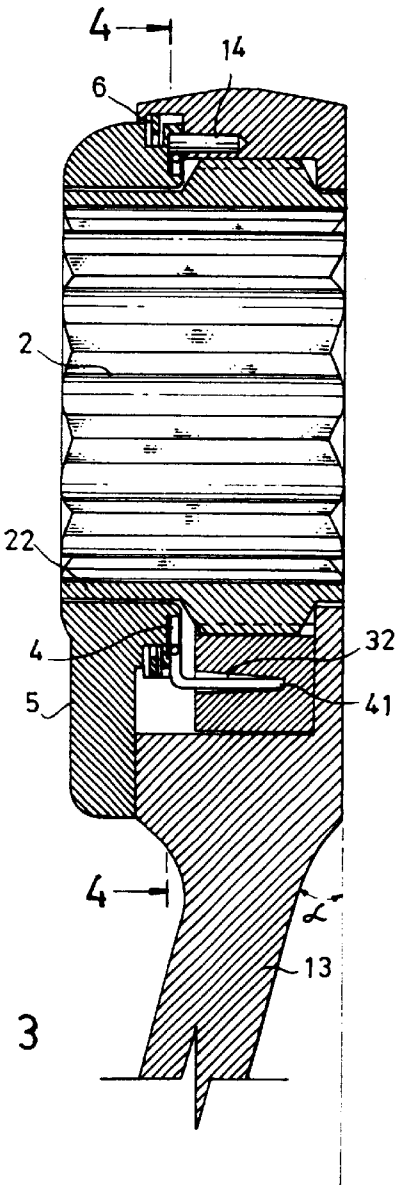
FIG. 3 is a side view in section of the double-reversible ratchet wrench shown in FIG. 1.

Referring to Figures from 1 through 3, a double-reversible ratchet wrench is shown comprised of a body 1, a ratchet wheel 2, a stop block 3, a retainer ring 4, an adjustment member 5, and a C-shaped clamp 6.

The body 1 comprises an elongated handle 13, and a head 11 axially upwardly extended from one end of the handle 13 at 15° angle. The head 11 comprises a receiving chamber 12 is formed of a stepped circular through hole 121 through top and bottom side walls thereof, and a notch 122 disposed in communication with the stepped circular through hole 121 adjacent to the handle 13. The head 11 further comprises a pin hole 1231 at one step 123 inside the stepped circular through hole 121 opposite to the notch 122. Further, a pin 14 is plugged into the pin hole 1231.

The ratchet wheel 2 is mounted within the stepped circular through hole 121, having a toothed portion 21 around the periphery, a first coupling portion 22 at one end, and a second coupling portion 22' at an opposite end.

The stop block 3 is a smoothly arched member mounted in the notch 122 at the body 1, having two toothed portions 31 bilaterally provided at its front side and a locating hole 32 at its top side on the middle.

The retainer ring 4 is formed by bending a steel wire rod into shape, having a zigzag section 42 on the middle defining a first retaining portion 421 and a second retaining portion 422 for engagement with the pin 14 inside the head 11 of the body 1 alternatively, and two positioning ends 41 attached together and fastened to the locating hole 32 at the stop block 3.

The adjustment member 5 fits the upper part of the receiving chamber 12 at the head 11 of the body 1, comprising a circular through hole 51 coupled to the first coupling portion 22 of the ratchet wheel 2, an outside annular groove 52 around the periphery, and a bottom positioning groove 53, which receives the retainer ring 4 inside the receiving chamber 12 at the head 11 of the body 1.

The C-shaped clamp 6 is mounted on the outside annular groove 52 of the adjustment member 5 within the stepped circular through hole 121 to secure the adjustment member 5 to the inside of the head 11 of the body 1.

Figure 4:
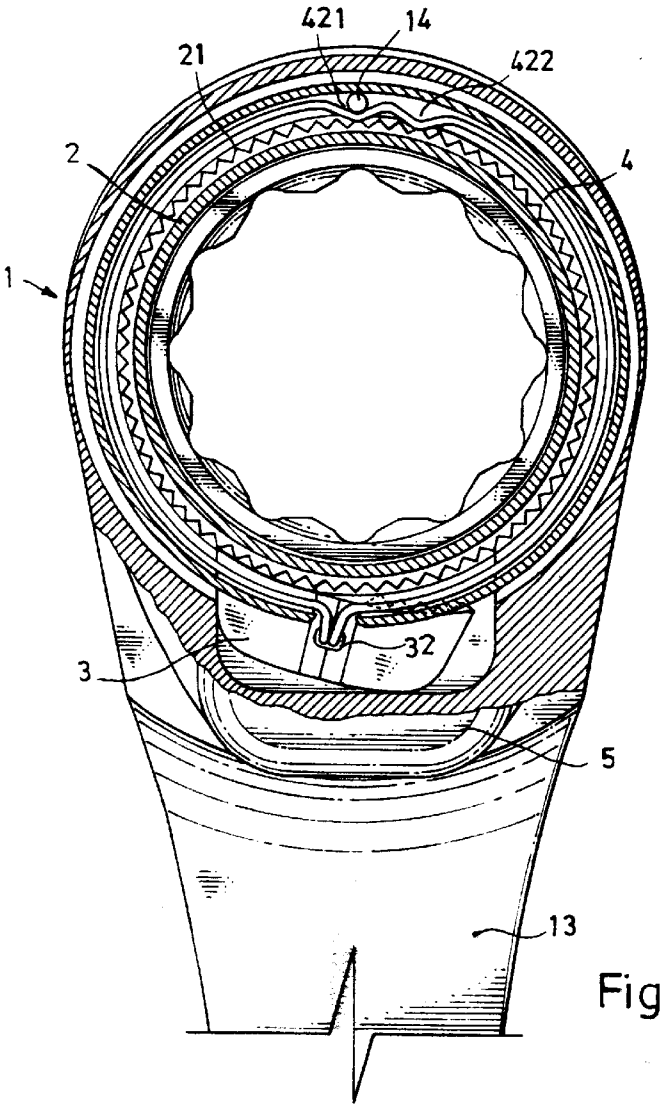
FIG. 4 is a sectional view taken line 4—4 of FIG. 3.

The assembly process of the double-reversible ratchet wrench is outlined hereinafter with reference to FIG. 4 and Figures from 1 through 3 again. the ratchet wheel 2 and the stop block 3 are respectively mounted in the stepped circular through hole 121 and notch 122 inisde the receiving chamber 12, enabling one toothed portion 31 of the stop block 3 to be forced into engagement with the toothed portion 21 of the ratchet wheel 2, then the retainer ring 4 is mounted in the receiving chamber 12 with its two positioning ends 41 respectively fastened to the locating hole 32 at the stop block 3 and its first retaining portion 421 or second retaining portion 422 forced into engagement with the pin 14 in the pin hole 1231, and then the adjustment member 5 is coupled to the first coupling portion 22 of the ratchet wheel 2 and fastened to the inside of the receiving chamber 12 inisde the head 11 by the C-shaped clamp 6, enabling the retainer ring 4 to be secured to the bottom positioning groove 53 at the bottom side of the adjustment member 5.

Figure 5:
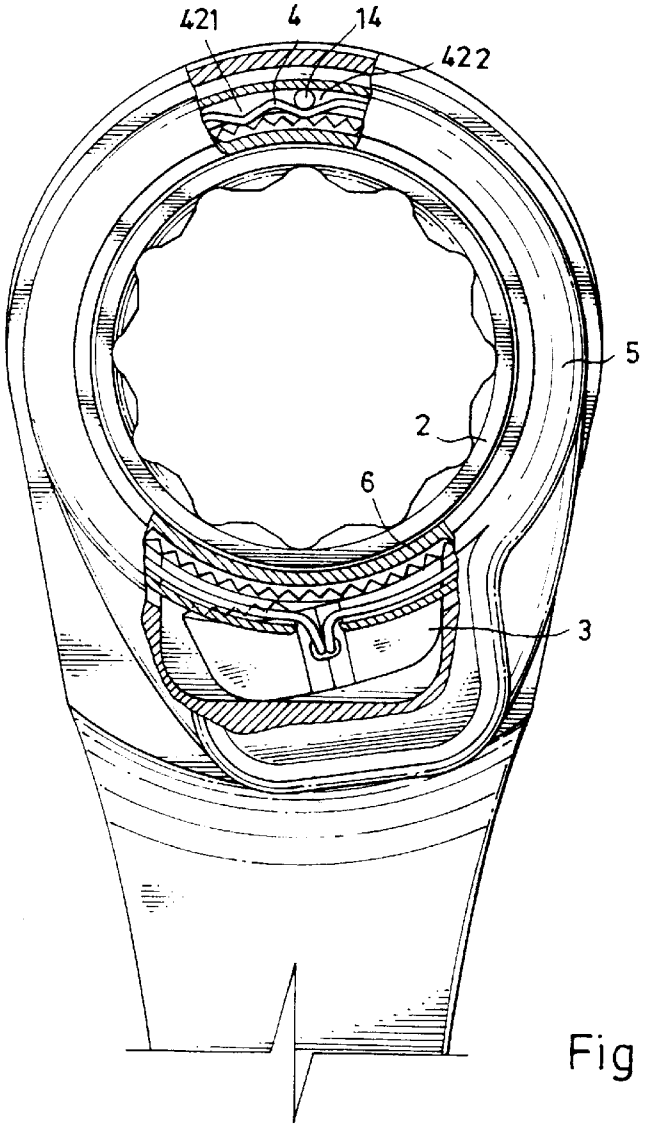
FIG. 5 illustrates the adjustment member adjusted, the engagement position between the stop block and the ratchet wheel changed according to the present invention.

Referring to FIG. 5 and FIG. 4 again, when assembled, the adjustment member 5 can be turned within the receiving chamber 12 between a first position shown in FIG. 4 and a second position shown in FIG. 5. When the adjustment member 5 is moved to the first position, one of the toothed portions 31 of the stop block 3 is meshed with the toothed portion 21 of the ratchet wheel 2, enabling the ratchet wheel 2 to be turned with the body 1 in one direction (the forward direction) or to run idle in the reversed (backward) direction (see FIG. 4). On the contrary, when the adjustment member 5 is moved to the second position, the other of the toothed portions 31 of the stop block 3 is meshed with the toothed portion 21 of the ratchet wheel 2, enabling the ratchet wheel 2 to be turned with the body 1 in one direction (the backward direction) or to run idle in the reversed (forward) direction (see FIG. 5).

Figure 6:
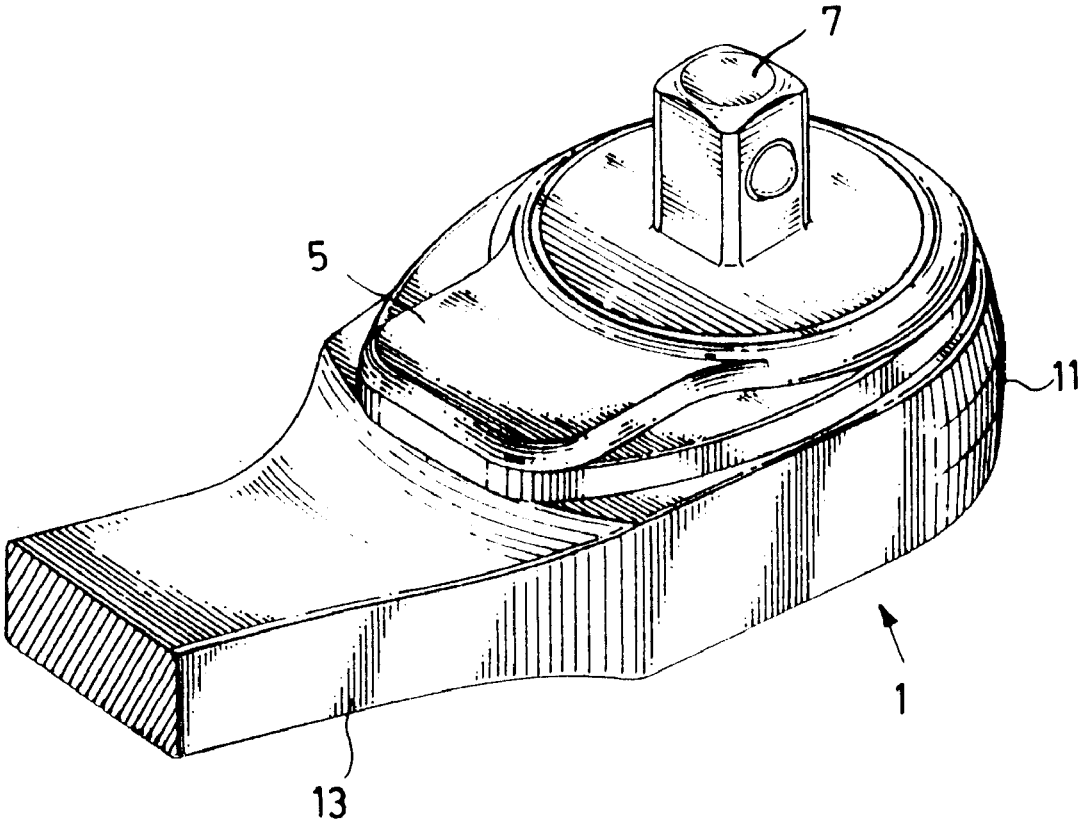
FIG. 6 is an applied view of the present invention, showing a socket driver coupled to the first coupling portion of the ratchet wheel according to the present invention.

Referring to FIG. 6, a socket driver 7 can be fastened to the first coupling portion 22 of the ratchet wheel 2 and used with a socket (not shown) to turn bolts, nuts, etc.

What is claimed is:

1. A double-reversible ratchet wrench comprising:

a body, said body comprising an elonaged handle, a head axially upwardly extended from one end of said handle at an angle, a receiving chamber provided at said head, said receiving chamber formed of a stepped circular through hole through top and bottom side walls of said head and a notch disposed in communication with said stepped circular through hole at one side, a pin hole at a step inside said stepped circular through hole opposite to said notch, and a pin fastened to said pin hole;

a ratchet wheel mounted within the stepped circular through hole inside the head of said body, said ratchet wheel comprising a toothed portion around the periphery thereof, a first coupling portion at one end, and a second coupling portion at an opposite end;

a stop block mounted in the notch inside said head of said body, said stop block having a smoothly arched member, two toothed portions bilaterally provided at a front side thereof and alternatively forced into engagement with the toothed portion of said ratchet wheel to limit direction of rotation of said ratchet wheel in said receiving chabmer, and a locating hole at a top side thereof on the middle;

a retaining ring mounted around the first coupling portion of said ratchet wheel and fastened to the locating hole at said stop block, said retainer ring having a zigzag section engaged with said pin inside said head of said body;

an adjustment member mounted in said receiving chamber inside said head of said body and turned to shift said stop block between two positions, enabling one of the two toothed portions of said stop block to be alternatively forced into engagement with the toothed portion of said ratchet wheel, said adjustment member comprising a circular through hole coupled to the first coupling portion of said ratchet wheel, an outside annular groove around the periphery thereof, and a bottom positioning groove, which receives said retainer ring; and a C-shaped clamp mounted on the outside annular groove of said adjustment member within the stepped circular through hole of said head of said body to secure said adjustment member to the inside of said head of said body.

2. The double-reversible ratchet wrench of claim 1 wherein said retainer ring is comprised of a steel wire rod bent into a loop a first retaining portion and a second retaining portion on the middle, which form said zigzag section, and two positioning ends attached together and fastened to the locating hole at said stop block.

* * * * *